US007681904B2

(12) United States Patent
Ekberg

(10) Patent No.: US 7,681,904 B2
(45) Date of Patent: Mar. 23, 2010

(54) CONFIGURABLE SNOWSHOE AND SKI DEVICE

(76) Inventor: Lane Ekberg, 7135 Ponderosa Dr., Salt Lake City, UT (US) 84121

( * ) Notice: Subject to any disclaimer, the term of this patent is extended or adjusted under 35 U.S.C. 154(b) by 595 days.

(21) Appl. No.: 11/247,893

(22) Filed: Oct. 7, 2005

(65) Prior Publication Data

US 2007/0079529 A1 Apr. 12, 2007

(51) Int. Cl.
*A63C 5/02* (2006.01)

(52) U.S. Cl. ..... 280/603; 280/601; 36/116; 36/123

(58) Field of Classification Search ..... 280/603, 280/616, 604, 607, 613, 617, 633, 631, 601; 36/125, 9 R, 122, 116, 123
See application file for complete search history.

(56) References Cited

U.S. PATENT DOCUMENTS

| | | | | |
|---|---|---|---|---|
| 579,695 | A | 3/1897 | Carmina-Morreale | |
| 1,101,631 | A | 6/1914 | Jacques | |
| 1,223,882 | A | 4/1917 | Jacques | |
| 2,260,057 | A | 10/1941 | Rydberg | 280/11.35 |
| 2,410,702 | A | 11/1946 | Arsenault | 36/4.5 |
| 3,090,978 | A | 5/1963 | Hanson | 9/310 |
| 3,484,958 | A | 12/1969 | Novak et al. | 36/4.5 |
| 3,525,166 | A | 8/1970 | Rieker et al. | 36/2.5 |
| 3,861,698 | A | 1/1975 | Greig | 280/11.13 |
| 4,334,369 | A | 6/1982 | Brunel | 36/124 |
| 4,620,375 | A | 11/1986 | Wallace | 36/7.6 |
| 4,674,764 | A | 6/1987 | Miesen | 280/604 |
| 4,720,928 | A | 1/1988 | Faber et al. | 36/122 |
| 5,353,522 | A | 10/1994 | Wagner | 36/7.7 |
| 5,440,827 | A | 8/1995 | Klebahn et al. | |
| 5,469,643 | A * | 11/1995 | Forrest | 36/122 |
| 5,553,403 | A | 9/1996 | McManus | 36/124 |
| 5,699,630 | A | 12/1997 | Klebahn et al. | |

(Continued)

FOREIGN PATENT DOCUMENTS

DE 3811253 A1 10/1989

(Continued)

OTHER PUBLICATIONS

Yupi skishoes, www.yupiskishoes.com.

(Continued)

*Primary Examiner*—Hau V Phan
(74) *Attorney, Agent, or Firm*—Kunzler Needham Massey & Thorpe

(57) ABSTRACT

A device is disclosed for a configurable snowshoe and ski device. The device includes a base member having a bottom for traversing over snow and ice covered terrain, a positionable axle rotatably coupling a mounting plate with the base member, and the axle positionable to enable one of a plurality of positions including a first position in which the mounting plate pivots above the plane of the base member and a second position in which the mounting plate pivots through the plane of the base member. The device may also include a plurality of wings coupled to the base member, the wings convertible between a skiing configuration in which the wings from a surface for gliding over snow and a snowshoe configuration in which the wings extend to increase the surface area of the base member.

23 Claims, 14 Drawing Sheets

U.S. PATENT DOCUMENTS

| | | | | |
|---|---|---|---|---|
| 5,857,272 | A | 1/1999 | Gallay | |
| 5,901,471 | A | 5/1999 | Warner | |
| 5,944,334 | A | 8/1999 | Zhao | 280/600 |
| 5,966,844 | A | 10/1999 | Hellerman et al. | 36/122 |
| 6,112,436 | A | 9/2000 | Quellais | 36/124 |
| 6,163,984 | A * | 12/2000 | Faber et al. | 36/125 |
| 6,233,849 | B1 | 5/2001 | Gallay et al. | 36/122 |
| 6,243,972 | B1 | 6/2001 | De France | 36/117.1 |
| 6,267,402 | B1 | 7/2001 | Julien | 280/602 |
| 6,347,805 | B1 | 2/2002 | Maravetz et al. | 280/624 |
| 6,367,173 | B2 | 4/2002 | Lancon | 36/122 |
| 6,374,518 | B2 | 4/2002 | Warner | 36/124 |
| 6,453,581 | B1 | 9/2002 | Kiniry et al. | |
| 6,505,423 | B1 | 1/2003 | Klebahn et al. | 36/124 |
| 6,604,755 | B2 | 8/2003 | Ayliffe et al. | |
| 6,612,605 | B2 | 9/2003 | Andrus et al. | 280/610 |
| 6,631,918 | B2 | 10/2003 | Silva | 280/607 |
| 6,637,766 | B2 | 10/2003 | Cuzzit et al. | 280/602 |
| 6,684,534 | B2 | 2/2004 | Dodge | 36/122 |
| 6,898,874 | B2 | 5/2005 | Emerson et al. | |
| 6,931,762 | B1 * | 8/2005 | Dua | 36/9 R |
| 7,207,126 | B2 | 4/2007 | Gantier | 36/72 |
| 2001/0038192 | A1 | 11/2001 | McManus et al. | 280/601 |
| 2002/0017771 | A1 | 2/2002 | McManus et al. | 280/600 |
| 2003/0052473 | A1 | 3/2003 | Perkins et al. | 280/624 |
| 2007/0163151 | A1 | 7/2007 | Monsees et al. | 36/122 |
| 2007/0209236 | A1 | 9/2007 | Ishak | 36/61 |

FOREIGN PATENT DOCUMENTS

| | | |
|---|---|---|
| EP | 1224879 | 1/2002 |
| EP | 1555050 | 1/2005 |
| FR | 2786371 | 11/1998 |
| WO | WO 0013538 | 3/2000 |

OTHER PUBLICATIONS

Play whistler.com, www.playwhistler.com.

TSL Snowshoes, http://www.tslsport.com/www/?country=us&lg=en.

Lowa Step-in Snowshoe http://www.allbusiness.com/retail-trade/miscellaneous-retail-miscellaneous/4255143-1.html.

1993 Iditasport, http://www.adventurecorps.com/when/iditasport/1993idit.html, Downloaded Mar. 5, 2005.

* cited by examiner

CONFIGURABLE SNOWSHOE AND SKI DEVICE

CROSS-REFERENCES TO RELATED APPLICATIONS

This application claims benefit of U.S. patent application Ser. No. 10/211,504 entitled "INVENTION THAT PROVIDES SNOWSHOE AND SKI FUNCTIONS" and filed on Aug. 2, 2002 for Lane Ekberg et al., U.S. patent application Ser. No. 10/932,777 entitled "CONFIGURABLE SNOWSHOE AND SKI DEVICE" and filed on Sep. 2, 2004 for Lane Ekberg, and U.S. patent application Ser. No. 11/044,981 entitled "CONVERTIBLE SNOWSHOE AND SKI DEVICE" and filed on Jan. 30, 2005 for Lane Ekberg, which is incorporated herein by reference.

BACKGROUND OF THE INVENTION

1. Field of the Invention

This invention relates to winter sports equipment and more particularly relates to a configurable snowshoe and ski device.

2. Description of the Related Art

Snowshoeing is a popular winter sport that provides backcountry exploration, exercise, and entertainment. Likewise, downhill skiing and snowboarding are enjoyed for Hi many of the same reasons. In a single day, backcountry enthusiasts typically snowshoe to their destination, and return on skis or snowboards. Unfortunately, the enthusiast must pack equipment for both snowshoeing and skiing or snowboarding. The added weight and hassle of packing up the necessary gear is an obvious disadvantage of this activity. However, many enthusiasts go through the hassle of packing extra gear in order to avoid the price of lift tickets, crowds at ski resorts, and to find untracked snow.

A solution to the added weight and expense of extra gear is to combine the utility of a snowshoe with that of a ski. Prior ski and snowshoe combinations have been formed with wings that are rotatable and substantially equivalent in length to the ski. A wing is attached to each side of the ski, and the wings rotate upward about a pair of hinges. When the wings are in the upward position the device functions as a ski, and conversely as a snowshoe when the wings are substantially parallel to the base of the ski. The device functions as intended, however the size and implementation of the wings cause contact with the leg of the user.

Not only do such wings limit the range of motion of the user, but the wings also accumulate snow on the device. Furthermore, snowshoeing is most effective when the ball of the user's foot is able to rotate through the plane of the snowshoe's top surface, thus allowing the toe of the foot to grip or dig into the surface of the snow. This is impossible with such a ski design with wings. Finally, it is advantageous for the pivot point of the foot to be located about one-third of the length of the snowshoe away from the front of snowshoe. Some snowshoes have this feature of foot placement and pivotability incorporated in their design as it requires less energy to walk or ascend hills. Also, the shorter protruding front section enables better mobility.

Another prior solution to the combination snowshoe/ski problem is a device which contains a short gliding surface functioning as a ski adjacent to a snowshoe surface. To convert from the ski surface to the snowshoe surface, one must remove the device, rotate the device 90° onto the edge, and reattach the device. Again, this device comes in contact with the legs of the user and limits the user's range of motion while in ski mode. Additionally, this type of snowshoe/ski does not allow the foot of the user to rotate through the plane of the snowshoe which aids in the traction or grip of the snow surface as seen in traditional snowshoes.

What is needed is a device that overcomes the added expense and weight of packing both snowshoes and skis or snowboards. Also, what is needed is a device that combines a snowshoe and ski while enabling a user's foot to rotate through the plane of the apparatus in order to facilitate walking and climbing. Additionally, a device that is easily converted, preferably without the requirement of removing the device.

SUMMARY OF THE INVENTION

The present invention has been developed in response to the present state of the art, and in particular, in response to the problems and needs in the art that have not yet been fully solved by currently available snowshoe/ski devices. Accordingly, the present invention has been developed to provide a configurable snowshoe and ski device that overcomes many or all of the above-discussed shortcomings in the art.

The device may include a base member having a bottom for traversing over snow and ice covered terrain, a positionable axle rotatably coupling a mounting plate with the base member. In one embodiment, the axle is positionable to enable one of a plurality of positions including a first position in which the mounting plate pivots above the plane of the base member and a second position in which the mounting plate pivots through the plane of the base member.

In a further embodiment, the device includes a plurality of wings coupled to the base member, the wings convertible between a skiing configuration in which the wings from a surface for gliding over snow and a snowshoe configuration in which the wings extend to increase the surface area of the base member. Each wing forms an outer edge for carving a turn on snow or ice when the plurality of wings is in the skiing configuration.

The device also comprises an opening configured to allow the mounting plate to rotate through the plane of the base member, and a removable skiable surface configured to engage the opening of the base member and form a substantially continuous skiing surface. In a further embodiment, the device includes a removable climbing skin having an upper surface configured to engage the base member, and a lower surface configured to engage snow or ice covered terrain.

In one embodiment, the device comprises a removable traction device configured to couple to a toe portion of the mounting plate and rotate through the plane of the base member. Also, the device may include a removable traction device configured to couple to one of a heel portion of the mounting plate or a bottom surface of the base member, and a quick release foot binding configured to releasably couple to the mounting plate. The base member is convertible into a device selected from the group consisting of a ski, snowshoe, approach ski, and telemark ski.

In a further embodiment, the base member comprises a ski configured to allow the toe portion of the mounting plate to pivot below the plane of the ski with the heel portion resting above the plane of the ski. Additionally, the mounting plate is removable and configurable as a separate climbing device.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
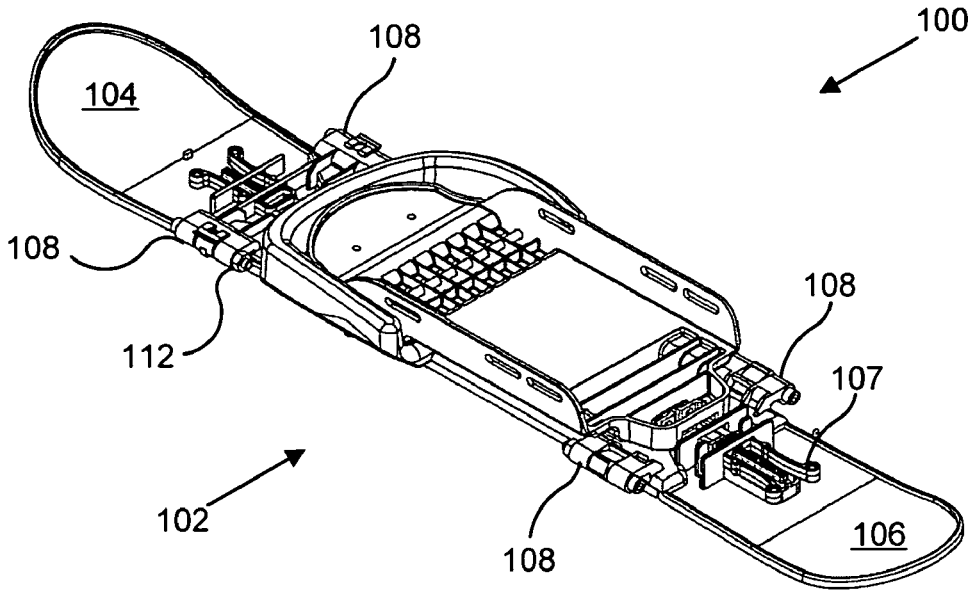
FIG. 1 is a perspective view diagram illustrating one embodiment of a configurable snowshoe and ski device in a ski configuration in accordance with the present invention.

FIG. 1 is a perspective view diagram illustrating one embodiment of a configurable snowshoe and ski device 100 in a ski configuration in accordance with the present invention. In one embodiment, the device 100 comprises a base member 102 having a front portion 104 and a rear portion 106. The front and rear portions 104, 106 may be removably coupled to the base member 102 using a locking device 107. In a further embodiment, the locking device 107 comprises a spring loaded, or tension mechanism having a plurality of shafts configured to engage a plurality of holes and secure the front and rear portions 104, 107 to the base member 102 (see FIGS. 5 and 9).

The device 100 may also include a plurality of hinges 108 configured to receive a plurality of wings 110 (see FIG. 2) and enable each wing 110 to rotate about the hinge 108. Additionally, a plurality of torsion spring pins 112 may couple the wing 110 to the hinge 108 and cause each wing 110 to extend outward laterally (see FIG. 2) and remain in a snowshoe configuration until manually rotated inward and locked in the skiing configuration with the locking device 107.

The device 100 may be formed of substantially one material. In one embodiment, the material may comprise a high-impact thermoset plastic such as, but not limited to, polyurethane. Alternatively, the device 100 may be formed of multiple materials, for example, the base member 102 may be formed of a lightweight aluminum while the plurality of wings 110 is formed of a plastic material.

Figure 2:
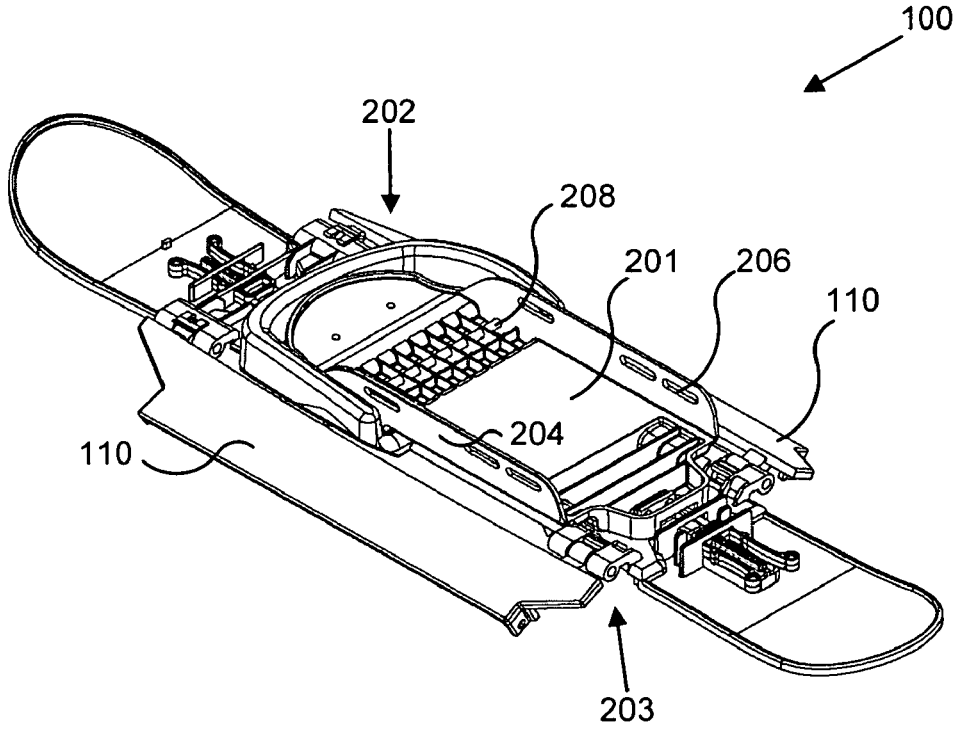
FIG. 2 is a perspective view diagram illustrating an alternative embodiment of the configurable snowshoe and ski device in a snowshoe configuration in accordance with the present invention.

FIG. 2 is a perspective view diagram illustrating an alternative embodiment of the configurable snowshoe and ski device 100 in a snowshoe configuration in accordance with the present invention. In one embodiment, the device comprises the wings 110 and a mounting plate 201 for receiving a binding device. The mounting plate includes a toe portion 202 and a heel portion 203. The mounting plate 201, in a further embodiment, is formed of substantially the same material as the base member 102. The mounting plate 201 may include side portions 204 extending upward and have slots 206 for securing the binding device.

The mounting plate 201, in one embodiment, is configured to pivot about a pivot point 208. The pivot point 208 may comprise an axle (not shown) configured to pass through the mounting plate 201 and secure the mounting plate 201 to the base member 102. The pivot point 208 also enables rotation of the mounting plate 201 such that toe portion 202 may pass through the plane of the base member 102 and the heel portion 203 may rise and fall as with the natural walking motion of a user.

Figure 3:
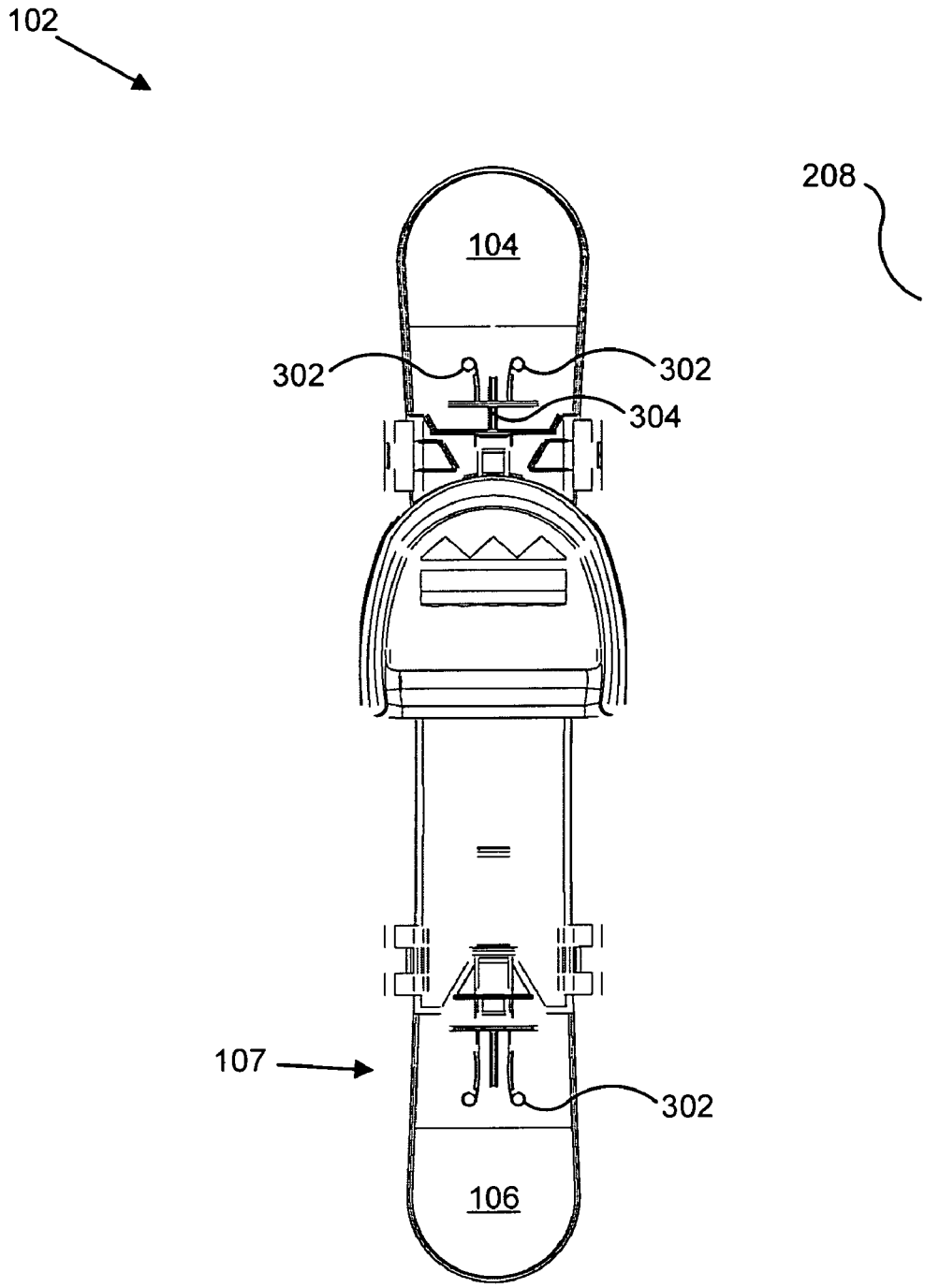
FIG. 3 is a top plan view illustrating one embodiment of the base member in accordance with the present invention.

FIG. 3 is a top plan view illustrating one embodiment of the base member 102*n* accordance with the present invention. In one embodiment, the front and rear portions 104, 106 are coupled to the base member 102 as described above with reference to FIG. 1. The locking devices 107 may include quick-release tabs 302 and shafts 304. The quick-release tabs may be pressed together thereby releasing the locking device 107 from the base member 102. Such quick-release systems are well known to those skilled in the art and therefore, will not be given further discussion herein.

Figure 4:
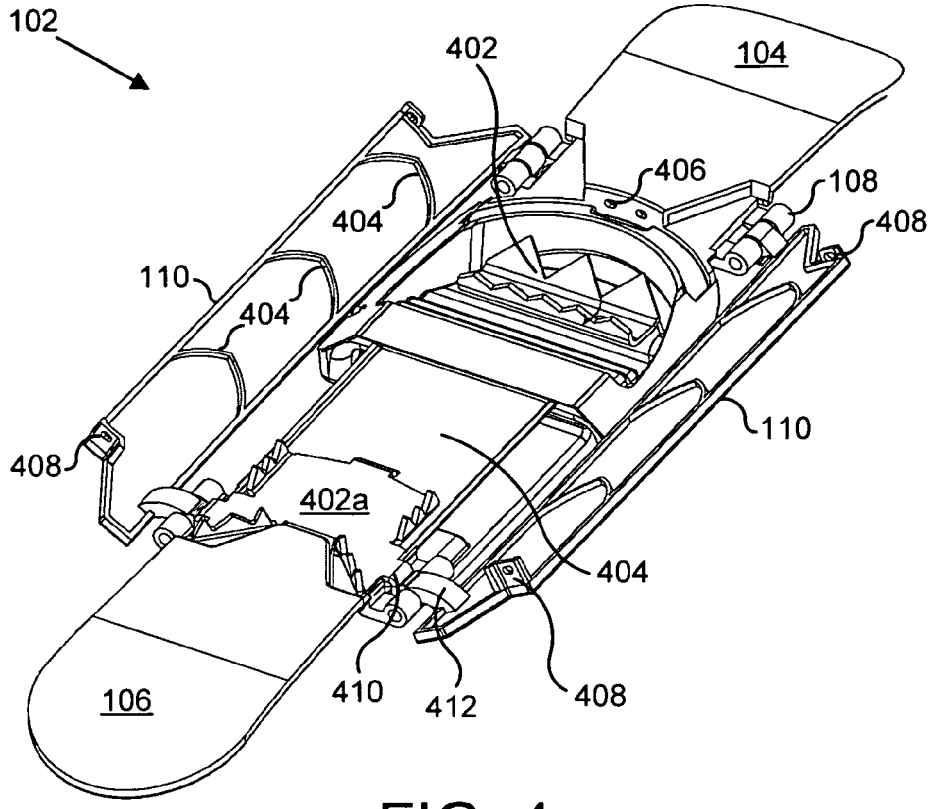
FIG. 4 is a bottom perspective view illustrating one embodiment of the base member in accordance with the present invention.

FIG. 4 is a bottom perspective view illustrating one embodiment of the base member 102 in the snowshoe configuration in accordance with the present invention. In one embodiment, the base member 102 comprises a plurality of traction devices 402. The traction devices 402 may be connected to a bottom surface 404 of the mounting plate 201. The traction devices 402 may be formed of substantially the same material as the base member 102, or alternatively of a metal-based material such as a lightweight titanium alloy, or the like. The traction devices 402 may be connected to the mounting plate 201 using a fastening device such a nut and bolt. In an alternative embodiment, the traction devices 402 and the mounting plate 201 are formed as a single unit.

In another embodiment, a removable traction device 402*a* may be implemented. The traction device 402*a* may include a tab 410 that extends perpendicularly from the traction device 402*a* and is configured to engage the surface of a wing hinge 412 such that the wing 110 is locked in the snowshoe configuration. The removable traction device 402*a* may have holes (not shown) configured to receive the locking device 107 and thereby be held in place by the locking device 107.

Bottom surfaces of the wings 110 may include a plurality of ridges 404 extending outward from the bottom surface of each wing 110. The plurality of ridges may be configured to increase the traction of the base member 102 while in the snowshoe configuration.

In a further embodiment, the base member 102 comprises a plurality of holes 406 for receiving the shaft of the locking device 107. Each wing 110 comprises a plurality of tabs 408, each tab 408 having a hole (not shown) that aligns with the hole 406 of the base member 102 when the wings 110 are rotated inward to form the ski configuration. With the hole 406 aligned with the hole of the tab 408, the shaft of the locking device 107 may engage both the base member 102 and the wing 110 in order to secure either the front or the rear portion 104, 106 to the base member and secure each wing 110 in the ski configuration.

Figure 5:
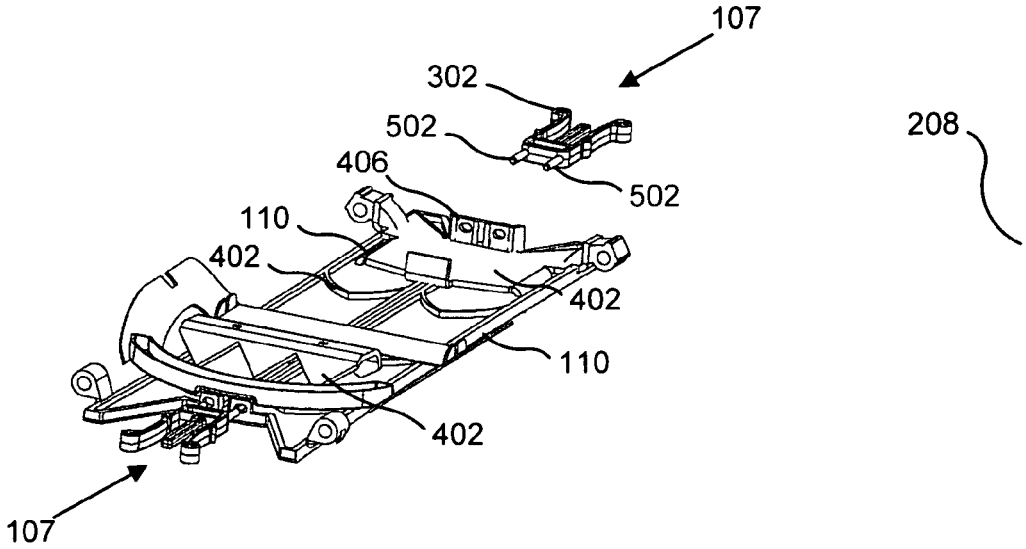
FIG. 5 is a bottom perspective view illustrating one embodiment of a plurality of wings in accordance with the present invention.

FIG. 5 is a bottom perspective view illustrating one embodiment of the plurality of wings 110 in the ski configuration in accordance with the present invention. In one embodiment, each locking device 107 comprises a plurality of shafts 502, each shaft 502 configured to engage the hole in one tab 408 of one wing 110. The inserted locking device 107 maintains the plurality of wings 110 in the ski configuration and prevents the traction devices from coming in contact with a surface, such as snow.

Figure 6:
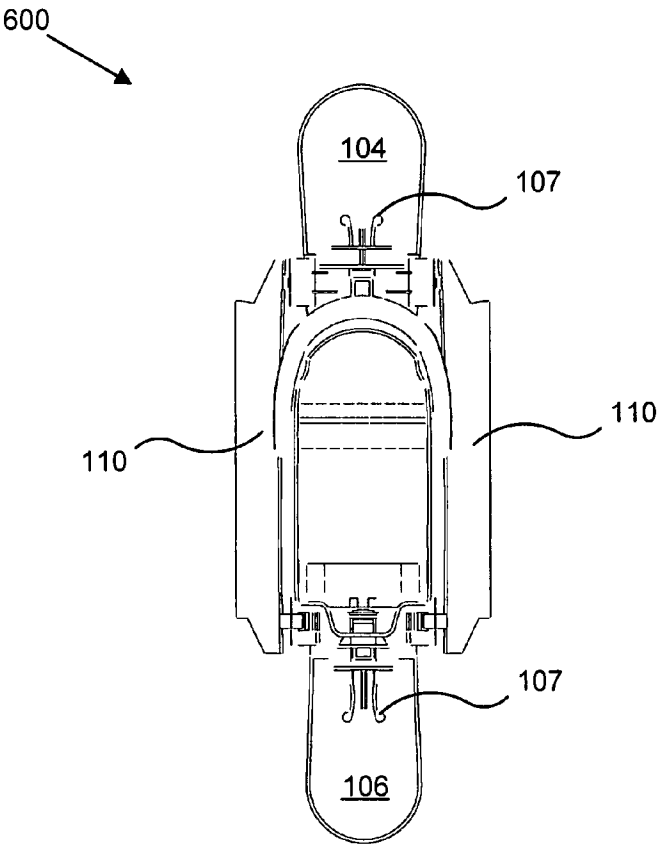
FIG. 6 is a top view diagram illustrating one embodiment of the snowshoe configuration in accordance with the present invention.

FIG. 6 is a top view diagram illustrating one embodiment of the snowshoe configuration in accordance with the present invention. In the depicted embodiment, the plurality of wings 110 extend laterally outward from the base member 102 to form the snowshoe configuration. The extension of the wings 110 effectively increases the bottom surface area of the device 100 and enables the user to traverse snow and ice covered terrain as with a traditional snowshoe. In a further embodiment, the front and/or rear portions may be removed while in snowshoe configuration 600 in order to facilitate traversal of snow and ice covered terrain.

Figure 7:
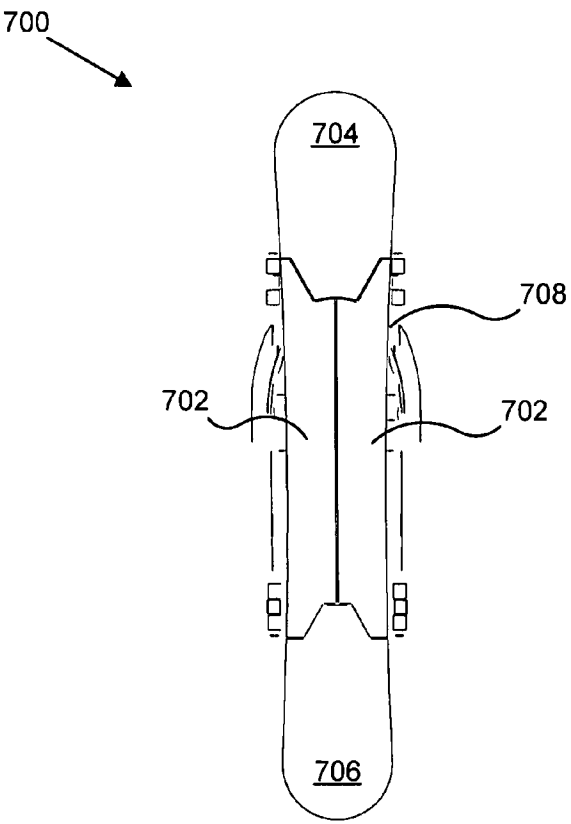
FIG. 7 is a bottom view diagram illustrating one embodiment of the ski configuration in accordance with the present invention.

FIG. 7 is a bottom view diagram illustrating one embodiment of the ski configuration 700 in accordance with the present invention. In one embodiment, the device 100 in ski configuration 700 includes bottom surfaces 702 of the wings and bottom surfaces 704, 706 of the front and rear portions. The bottom surfaces 702, 704, 706 in ski configuration together form a substantially continuous skiing surface with a low coefficient of friction for gliding over snow and ice covered terrain.

The bottom surfaces 702, 704, 706, may be waxed in a manner similar to traditional skis and snowboards. In a further embodiment, the device 100 in ski configuration 700 may include edges 708 having a generally concave shape for turning on ice or snow. The edges 708 may be formed of metal as with a ski or snowboard. The edges 708 may extend on each side of the device from the front portion 104 to the rear portion 106. Alternatively, the edges 708 may be formed only on the wing 110 portions of the bottom surface.

Figure 8:
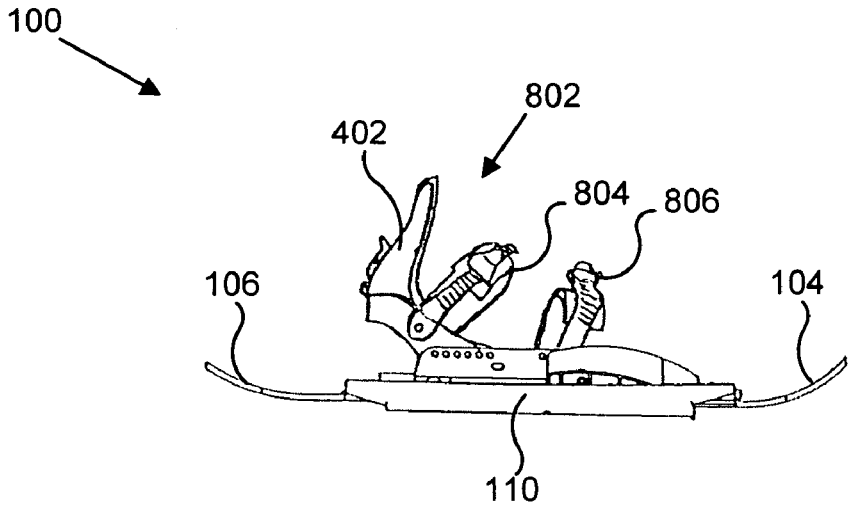
FIG. 8 is a side view diagram illustrating on embodiment of the device in the snowshoe configuration and having a binding device in accordance with the present invention.

FIG. 8 is a side view diagram illustrating on embodiment of the device in the snowshoe configuration and having a binding device 802 in accordance with the present invention. In one embodiment, the binding device 802 comprises an adjustable ankle strap 804 and an adjustable toe strap 806. Additionally, the binding device 802 may include a calf support assembly 808. The binding device 802 may comprise a standard snowboard binding system having ratchet straps for securing the foot of the user. Alternatively, the binding device 802 may comprise a traditional locking downhill or cross-country ski binding.

Figure 9:
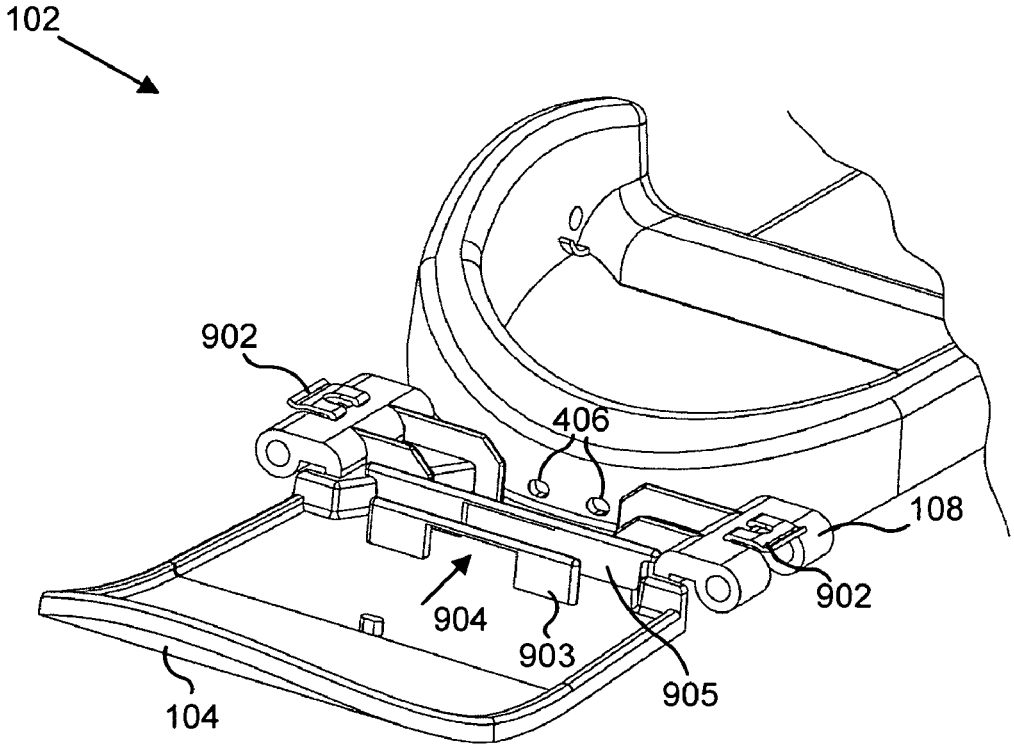
FIG. 9 is a front perspective view diagram illustrating one embodiment of a front portion of the device in accordance with the present invention.

FIG. 9 is a front perspective view diagram illustrating one embodiment of a front portion 104 of the device in accordance with the present invention. In one embodiment, the base member 102 comprises a plurality of second locking devices or wing locking tabs 902. The wing locking tabs 902 may be coupled to the hinges 108 and configured to snap into a slot (not shown) of the wing 110 when the wing 110 is rotated outward to the snowshoe configuration.

In a further embodiment, the front portion 104 includes a plate 903 extending upward from the front portion 104 and having an opening 904 for receiving the locking device 107. The base member 102 likewise may have a similarly sized plate 905 having an opening (not shown) and configured to engage a surface of the first plate 903.

The locking device 107 is configured to pass through the openings 904 in the plates 903, 905 and engage the holes 406 of the base member 102. As described above, the locking device may simultaneously engage the front portion 104, the base member 102, and the tabs 408 of the wings 110. The quick-release tabs 302 of the locking device 107 also are configured to pass through the opening 904 and engage the plate 905.

Similarly, the locking device 107 may couple the rear portion 106 to the base member 102 while engaging and securing both the wings 110 and the heel 203 of the mounting plate. Securing the heel portion 203 of the mounting plate 201 enables the user to ski in a manner similar to a downhill skier.

Figure 10:
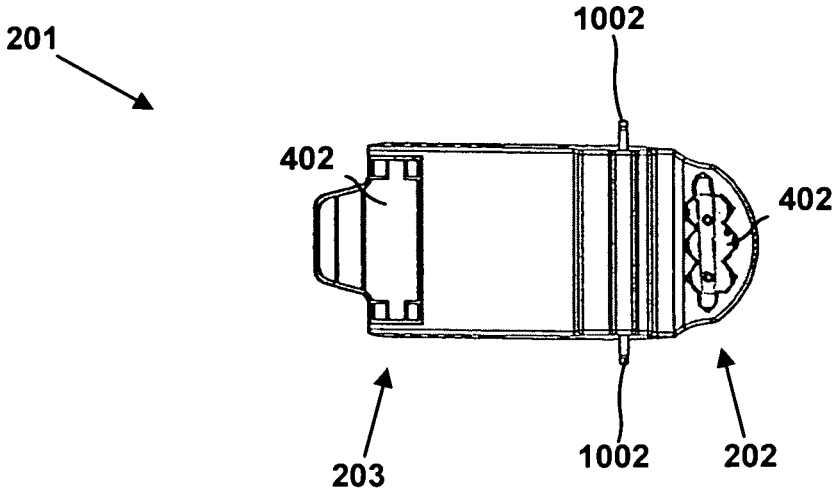
FIG. 10 is a top view diagram illustrating one embodiment of a mounting plate in accordance with the present invention.

FIG. 10 is a top view diagram illustrating one embodiment of the mounting plate 201 in accordance with the present invention. In one embodiment, the mounting plate 201 is formed to roughly the size of a boot. The mounting plate 201 may be formed to different sized in order to accommodate different size users. The axle 1002 (as described above with reference to FIG. 2) is configured to pass through the mounting plate 201 and secure the mounting plate 201 to the base member 102 while allowing the mounting plate 201 to pivot about the axle 1002.

Figure 11:
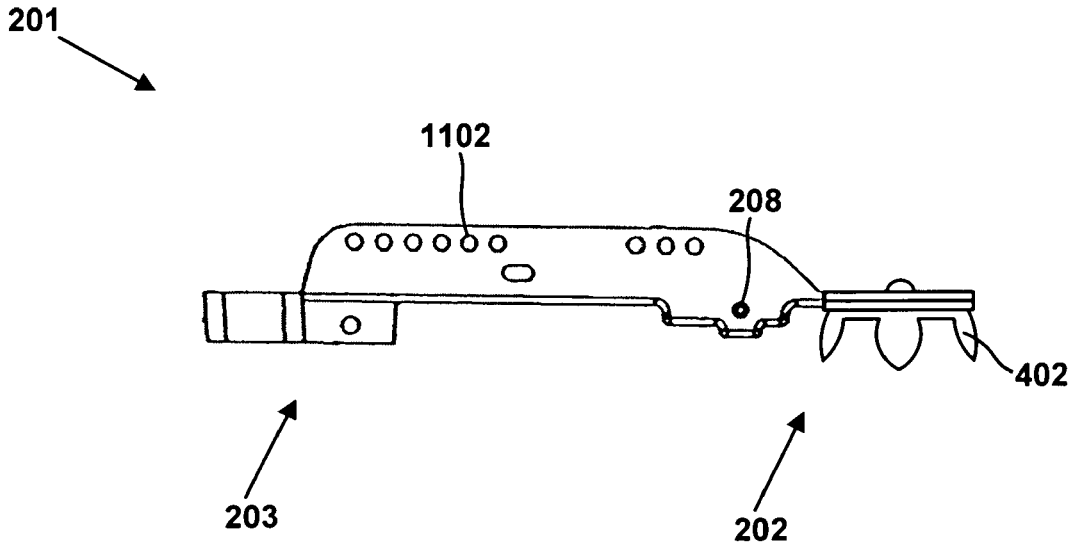
FIG. 11 is side view diagram of the mounting plate in accordance with the present invention.

FIG. 11 is side view diagram of the mounting plate 201 in accordance with the present invention. In a further embodiment, the mounting plate 201 may comprise a plurality of holes 1102 for securing the binding device 802. The plurality of holes 802 enables the user to position the binding device 802 to suit his or her boot size. As depicted, the pivot point 208 is located generally beneath the ball of the foot (not shown) of the user. However, the pivot point 208 may be adjusted to suit the comfort of the user.

The schematic flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting period of unspecified duration between enumerated steps of the depicted method. Additionally, the order in which a particular method occurs may or may not strictly adhere to the order of the corresponding steps shown.

Figure 12:
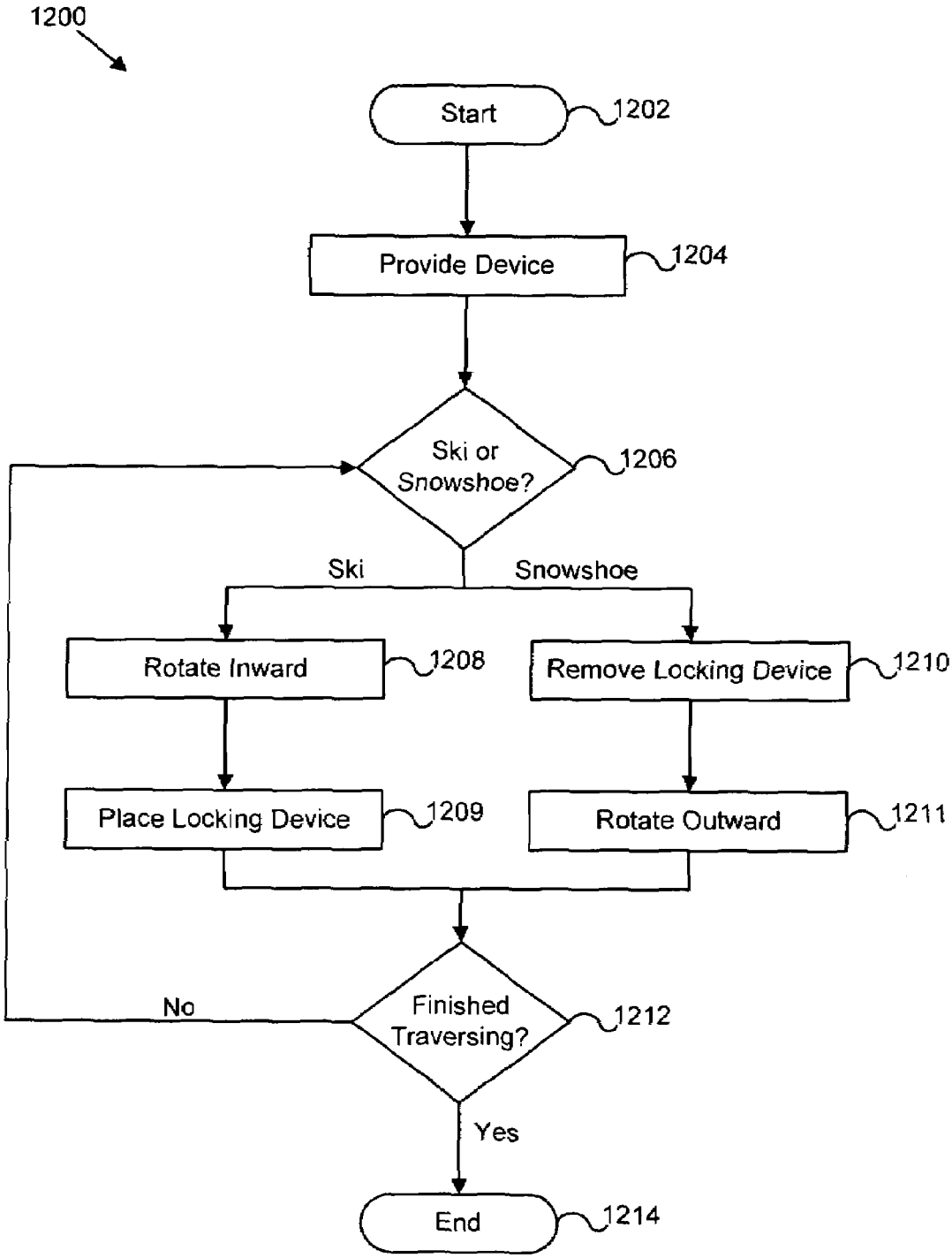
FIG. 12 is a schematic flow chart diagram illustrating one embodiment of a method for configuring the snowshoe ski device in accordance with the present invention.

FIG. 12 is a schematic flow chart diagram illustrating one embodiment of a method 1200 for configuring the snowshoe ski device in accordance with the present invention. The method 1200 starts 1202 and a snowshoe ski device 100 is provided. In one embodiment, providing 1202 the snowshoe ski device 100 comprises injection molding the device 100 from substantially the same material. The material may be a high-impact plastic. Alternatively, providing 1202 the device 100 may comprise forming the device from composite materials such as metal-based composites.

The user then decides 1206 whether to use the device 100 in ski configuration or snowshoe configuration. If the user chooses 1206 ski configuration, the wings are rotated 1208 inwards to form the substantially continuous skiing surface and places 1209 the locking devices 107 into the holes 406.

Alternatively, if the user chooses 1206 the snowshoe configuration, the user removes 1210 the locking devices 107 by compressing the quick-release tabs 302 and releasing the wings 110. The torsion spring pins 112 cause the wings 110 to rotate outward 1211 and form the snowshoe configuration. The user may then decide whether to leave the front and rear portions 104, 106 attached to the base member 102. If the user is finished 1212 traversing snow and ice covered terrain, the method 1200 ends.

Figure 13:
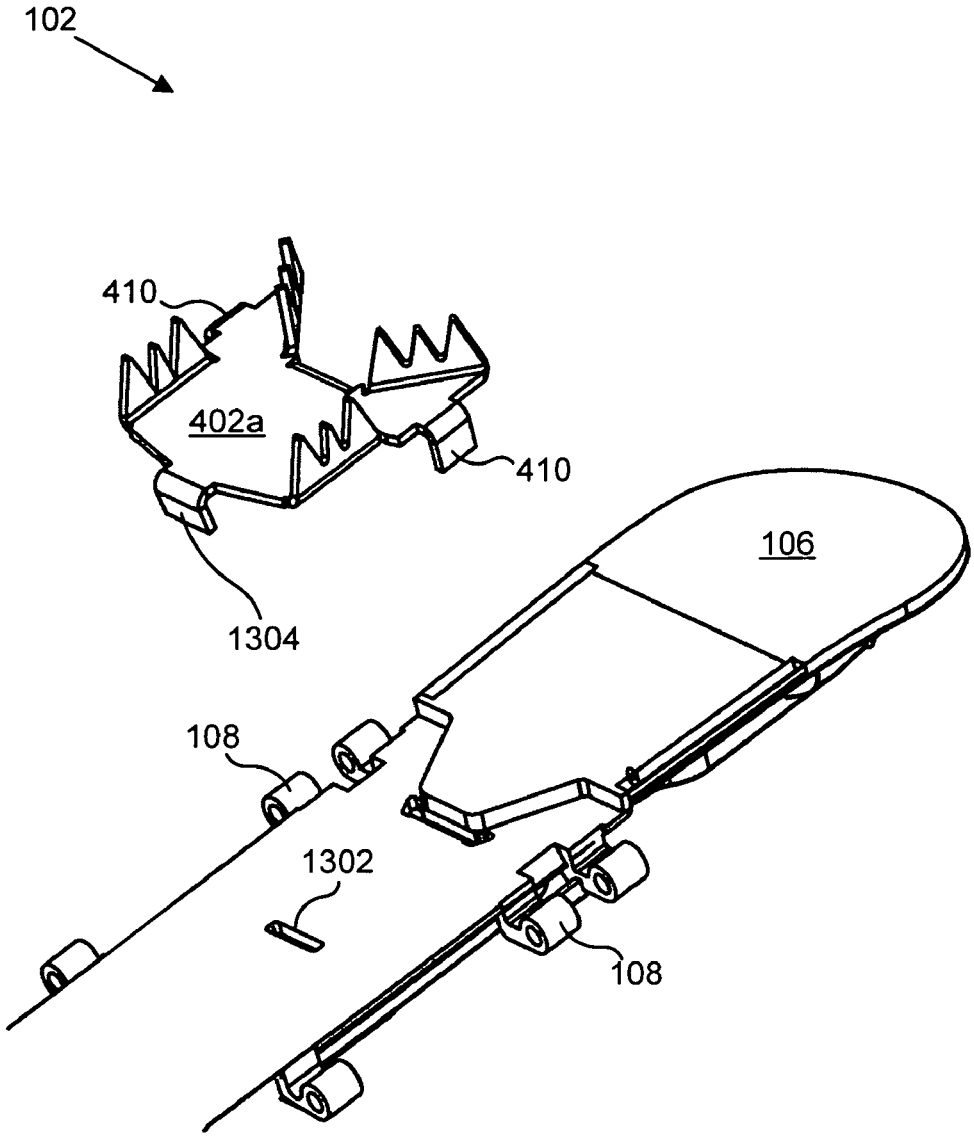
FIG. 13 is bottom view diagram illustrating one embodiment of a removable traction device in accordance with the present invention.

FIG. 13 is a bottom view diagram illustrating one embodiment of the removable traction device 402*a* in accordance with the present invention. The removable traction device 402*a* may comprise a crampon. In one embodiment, the base member 102 includes a slot 1302 for receiving a tab 1304. The slot 1302 together with the tab 1304 ensure proper alignment of the removable traction device 402*a*.

In a further embodiment, the removable traction device 402*a* includes tab 410 that extends perpendicularly from the traction device 402*a* and are configured to engage the surface of a wing hinge 412 (not shown) such that the wing 110 is locked in the snowshoe configuration, as described above with reference to FIG. 4. The removable traction device 402*a* may have holes (not shown) configured to receive the locking device 107 and thereby be held in place by the locking device 107.

Figure 14:
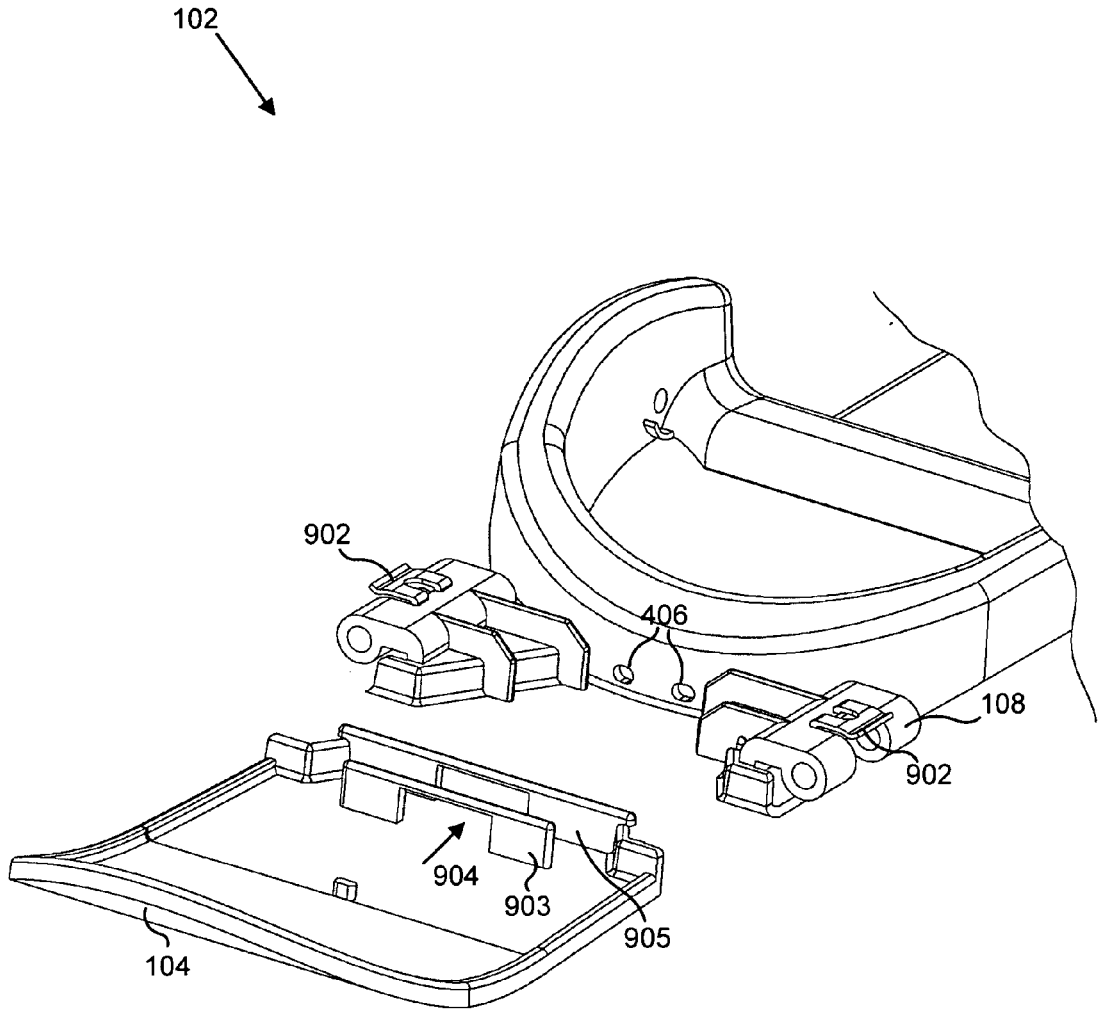
FIG. 14 is a top view diagram illustrating one embodiment of a removable front portion in accordance with the present invention.

FIG. 14 is a top view diagram illustrating one embodiment of a removable front portion 104 in accordance with the present invention. The removable front portion 104 may be constructed substantially from the same material as the base member 102. In one embodiment, the removable front portion 104 may be coupled to the base member using the locking device 107. The locking device 107 is configured to pass through the openings 904 in the plates 903, 905 and engage the holes 406 of the base member 102.

As described above, the locking device may simultaneously engage the front portion 104, the base member 102, and the tabs 408 of the wings 110. The quick-release tabs 302 of the locking device 107 also are configured to pass through the opening 904 and engage the plate 905. Accordingly, the locking device 107 may be configured to couple the front portion 104 to the base member 102 while simultaneously locking the wings 110 in the closed ski configuration. Alternatively, the front portion 104 may be removed or left in place while the device 100 is in the snowshoe configuration, according to user preference.

Figure 15:
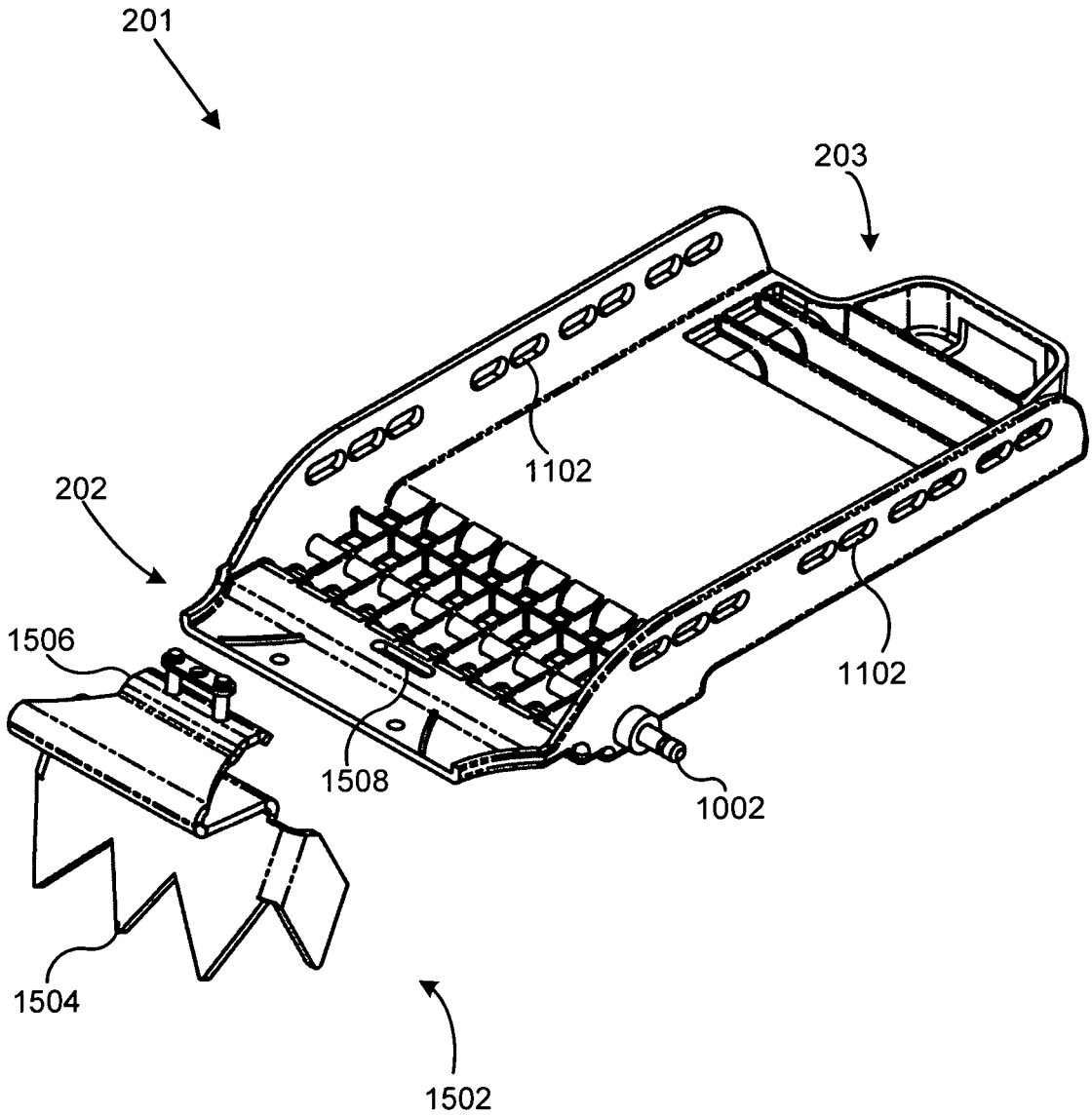
FIG. 15 is a top perspective view diagram illustrating one embodiment of a mounting plate having a removable traction device in accordance with the present invention.

FIG. 15 is a top perspective view diagram illustrating one embodiment of a mounting plate 201 having a removable traction device 1502 in accordance with the present invention. In one embodiment, the mounting plate 201 is configured as described above having a plurality of holes 1102 for securing the binding device, the heel portion 203, and the axle 1002. The removable traction device 1502 is configured to slidably engage the mounting plate 201. In a further embodiment, the removable traction device 1502 may engage the toe portion 202.

The removable traction device 1502, in one embodiment may comprise a removable crampon or cleat. In a further embodiment, the removable traction device 1502 comprises a plurality of downwardly extending teeth 1504 or spikes configured to grip snow or ice covered terrain. The removable traction device 1502 may include a locking pin 1506 for securing the removable traction device 1502 to the mounting plate 201.

In one embodiment, the mounting plate 201 comprises a slot 1508 configured to receive the locking pin 1506 of the removable traction device 1502. The locking pin 1506 slides into the slot 1508 and secures the removable traction device 1502 to the mounting plate 201. In a further embodiment, an additional securing device may be provided to secure the removable traction device 1502 to the mounting plate 201. Examples of additional securing devices may include, but are not limited to, hook and loop mechanisms, nut and bolt securing devices, rivets, etc.

Figure 16:
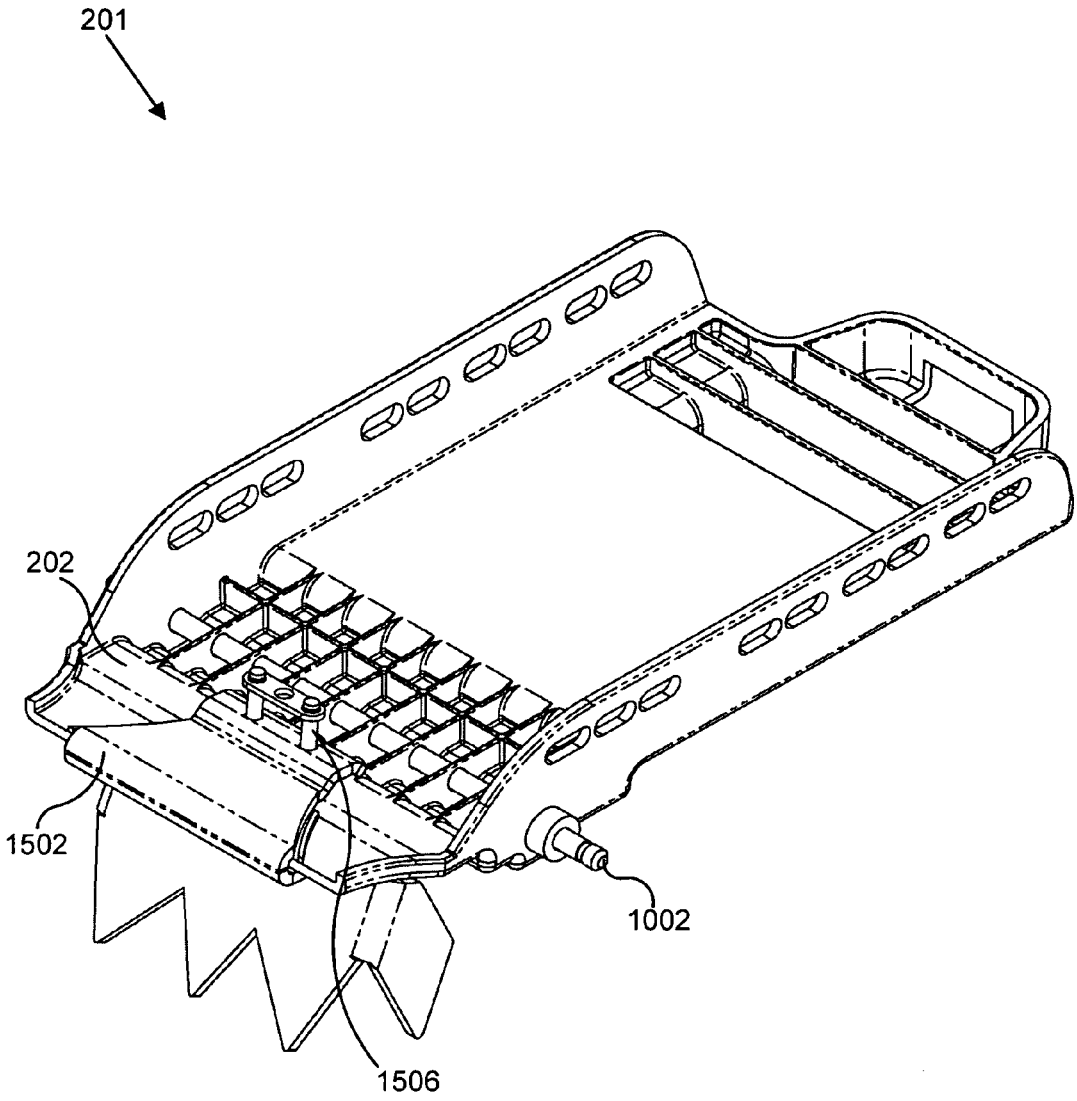
FIG. 16 is a top perspective view diagram illustrating another embodiment of the mounting plate in accordance with the present invention.

FIG. 16 is a top perspective view diagram illustrating another embodiment of the mounting plate 201 in accordance with the present invention. As described above with reference to FIG. 15, the mounting plate 201 may comprise the removable traction device 1502. The removable traction device 1502 engages the toe portion 202 of the mounting plate 201. The locking pin 1506, depicted here in an "unlocked" position, is configured to slide into the slot 1508 (not shown here) and secure the removable traction device 1502. Upon sliding the locking pin 1506 into the slot 1508, the locking pin 1506 is recessed and a boot may be secured to the mounting plate 201.

Figure 17:
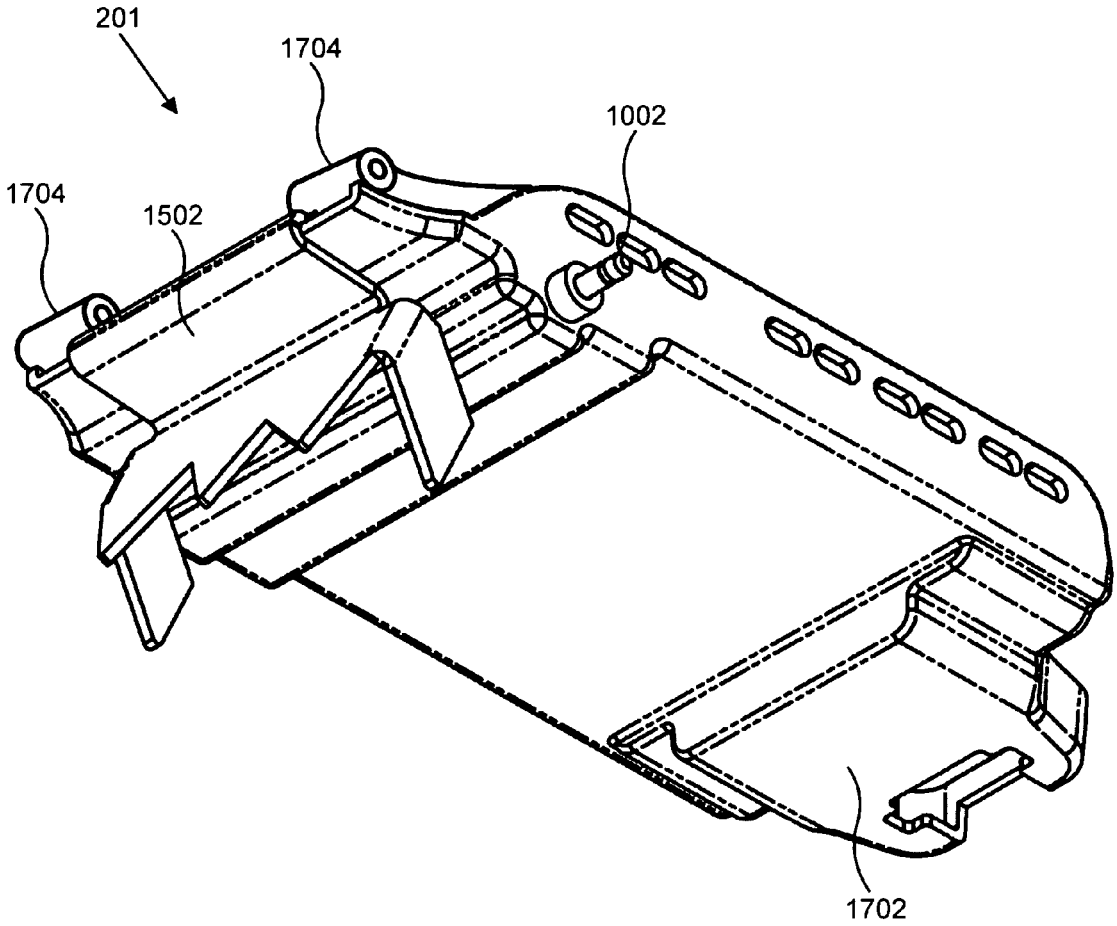
FIG. 17 is a bottom perspective view diagram illustrating one embodiment of the mounting plate in accordance with the present invention.

FIG. 17 is a bottom perspective view diagram illustrating one embodiment of the mounting plate 201 in accordance with the present invention. The mounting plate 201, when coupled with the binding device, may be used in a manner separate from the base member 102 to provide traction on hard packed snow or ice covered terrain. For example, the mounting plate 201 may be used in situations when the surface area of the base member 102 is not required to maintain the user above the plane of the snow or ice covered terrain. The mounting plate 201 is configured to receive various different types of binding systems, such as, but not limited to, snowboard binding systems, fixed heel ski binding systems, and free heel ski binding systems.

In a further embodiment, the mounting plate 201 may be incorporated into the sole of a boot or shoe. For example, a snowboard or hiking boot may be confirgured with a sole having a plurality of openings through which the axle 1002 may pass and thereby secure the boot to the base member 102.

The mounting plate 201, in one embodiment, comprises pivot points 1704 through which the axle 1002 pass in order to secure the mounting plate 201 to the base member 102. The axle 1002 is positionable and may be placed under the ball of the foot (as depicted in FIG. 17) so that the mounting plate 201 pivots through the plane of the base member. Alternatively, the axle 1002 may be placed through the pivot points 1704 which results in the mounting plate pivoting above the plane of the base member 102. Such a configuration enables a skiing motion similar to telemark or cross-country skiing.

Figure 18:
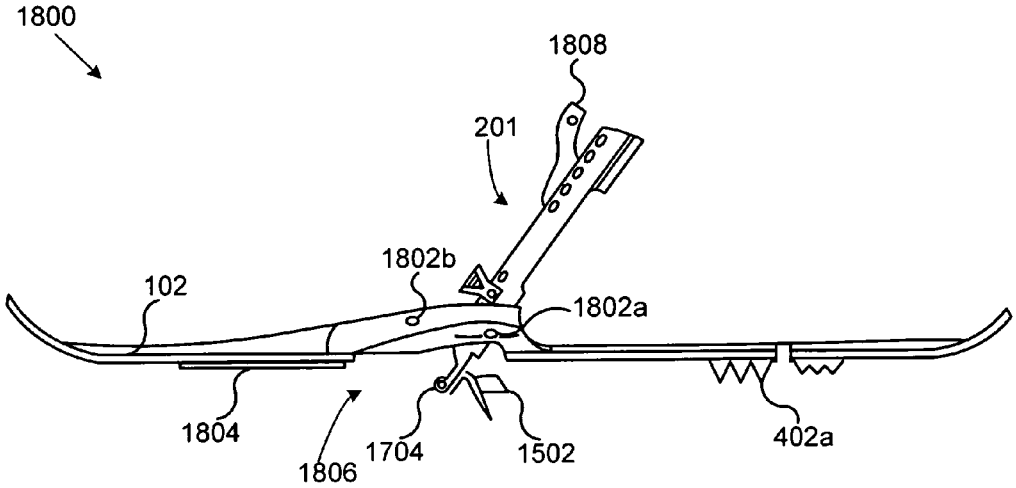
FIG. 18 is a schematic block diagram illustrating one embodiment of an approach ski in accordance with the present invention.

FIG. 18 is a schematic block diagram illustrating one embodiment of an approach ski 1800 in accordance with the present invention. In one embodiment, the base member 102 may comprise an approach ski 1800 having no extendable wings. Approach skis, as used herein, refers to lightweight rapid ascent devices for transporting a user to backcountry areas. In certain embodiment, approach skis may be equipped with climbing skins.

In one embodiment, the base member 102 includes a plurality of axle pivot points 1802 for allowing the mounting plate 201 to pivot through the plane of the base member 102 as with axle pivot point 1802*a*. Alternatively, the axle may be repositioned into the axle pivot point 1802*b* to enable the mounting plate 201 to pivot above the plane of the base member 102. Each axle pivot point 1802 has benefits depending on the situation. For example, on gentle inclines the user may prefer to place the axle in the axle pivot point 1802*b* so that the approach ski behaves more like a cross country ski. In other situations, the user may desire that the removable traction device 1502 digs deeper into snow or ice covered terrain as provided by the axle pivot point 1802*a*.

In a further embodiment, the approach ski 1800 includes a removable skiable surface 1804. The removable skiable surface 1804 (hereinafter "surface 1804") may be rotatably coupled such that the surface 1804 pivots to create an opening 1806 through which the mounting plate 201 may pass. The surface 1804 may pivot toward the front of the ski and be secured to the bottom surface of the base member 102. Furthermore, the surface 1804, when placed in the opening 1806 forms a substantially continuous skiing surface for gliding over snow or ice covered terrain. The mounting plate, in one embodiment, may include a foot size adjuster 1808 positionable for different size foots.

Figure 19:
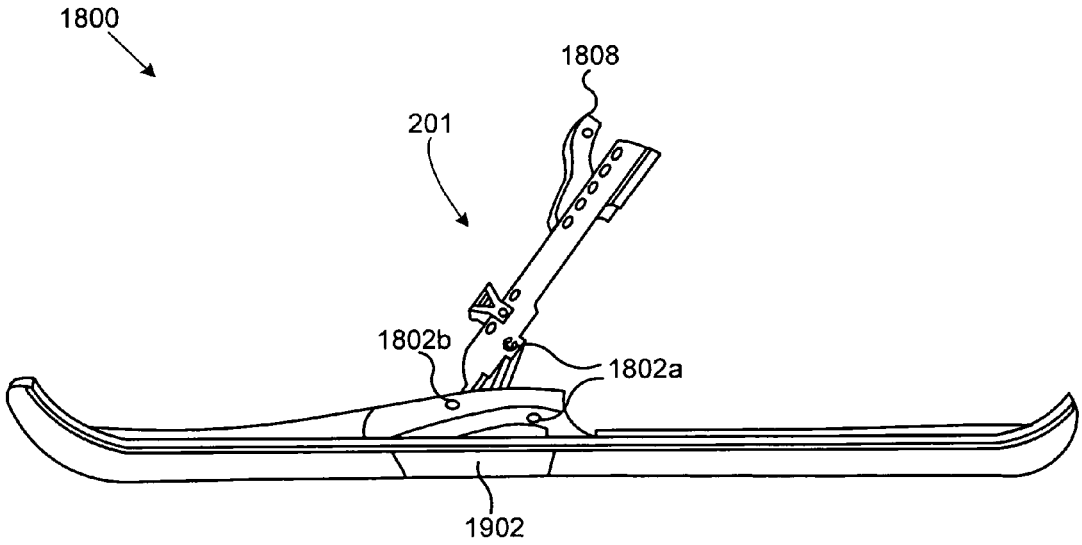
FIG. 19 is a schematic block diagram illustrating one embodiment of the approach ski in accordance with the present invention.

FIG. 19 is a schematic block diagram illustrating one embodiment of the approach ski 1800 in accordance with the present invention. In one embodiment, the approach ski 1800 is configured with the removable skiable surface 1804 for placing in the opening 1806 in the base member 102 in order to create a continuous skiing surface. When climbing with the depicted approach ski 1800, the mounting plate 201 pivots about the axle pivot point 1802*b* with the heel portion left free to provide a natural walking motion similar to telemark or cross-country skiing.

Figure 20:
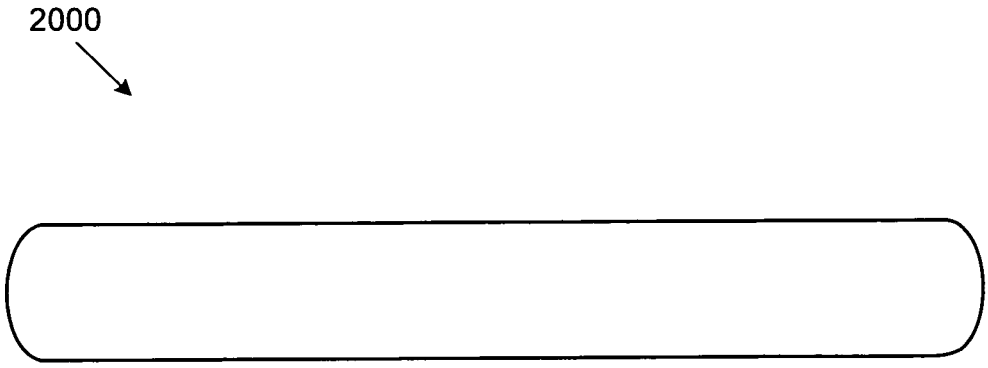
FIG. 20 is a schematic block diagram illustrating one embodiment of a climbing skin in accordance with the present invention.

FIG. 20 is a schematic block diagram illustrating one embodiment of a climbing skin 2000 in accordance with the present invention. The climbing skin 2000 may be attached to the base member 102 in a manner such that when the base member is moved forward the climbing skin 2000 glides over the snow. The bottom or ground engaging surface of the climbing skin 2000 comprises a plurality of tiny hairs that prevent the ski from sliding backwards thereby enabling ascending an incline. The climbing skin 2000 may be attached using clips at each end (not shown) configured to attach to the base member, or alternatively, the climbing skin 2000 may be covered with an adhesive configured to securely, but removably, attach the climbing skin 2000 to the base member. Climbing skins 2000 are well known to those skilled in the art and will not be given further discussion herein.

Figure 21:
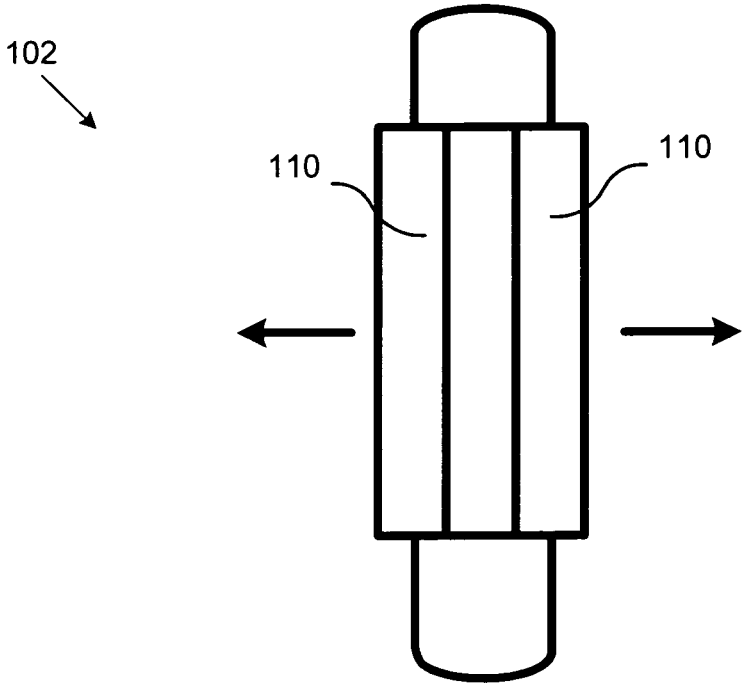
FIG. 21 is a schematic block diagram illustrating one embodiment of the base member in accordance with the present invention.

FIG. 21 is a schematic block diagram illustrating one embodiment of the base member 102 in accordance with the present invention. The base member 102 may be configured with slidable wings 110 instead of rotating wings. For example, the base member 102 may be configured with slots from in which Alternatively, the wings 110 may extend like a telescope, or alternatively, in a manner similar to an accordion.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device for traversing snow and ice covered terrain, the device comprising:

a base member having a bottom for traversing over snow and ice covered terrain;

a positionable axle rotatably coupling a mounting plate with the base member;

the axle positionable to enable one of a plurality of positions including a first position in which the mounting plate pivots above the plane of the base member and a second position in which the mounting plate pivots through the plane of the base member; and a plurality of wings coupled to the base member, the wings convertible between a skiing configuration in which the wings from a surface for gliding over snow and a snowshoe configuration in which the wings extend to increase the surface area of the base member.

2. The device of claim 1, wherein each wing forms an outer edge for carving a turn on snow or ice when the plurality of wings is in the skiing configuration.

3. The device of claim 1, wherein the base member further comprises an opening configured to allow the mounting plate to rotate through the plane of the base member.

4. The device of claim 1, further comprising a removable skiable surface configured to engage the opening of the base member and form a substantially continuous skiing surface.

5. The device of claim 1, further comprising a removable climbing skin having an upper surface configured to engage the base member, and a lower surface configured to engage snow or ice covered terrain.

6. The device of claim 1, further comprising a removable traction device configured to couple to a toe portion of the mounting plate and rotate through the plane of the base member.

7. The device of claim 1, further comprising a removable traction device configured to couple to one of a heel portion of the mounting plate or a bottom surface of the base member.

8. The device of claim 1, further comprising a quick release foot binding configured to releasably couple to the mounting plate.

9. The device of claim 1, wherein the base member is convertible into a device selected from the group consisting of a ski, snowshoe, approach ski, and telemark ski.

10. The device of claim 1, wherein the base member comprises a ski configured to allow the toe portion of the mounting plate to pivot below the plane of the ski with the heel portion resting above the plane of the ski.

11. The device of claim 1, wherein the mounting plate is removable and configurable as a separate climbing device.

12. A device for traversing snow and ice covered terrain, the device comprising:

a base member having a bottom for traversing over snow and ice covered terrain;

a plurality of wings coupled to the base member, the wings convertible between a skiing configuration in which the wings from a surface for gliding over snow and a snowshoe configuration in which the wings extend to increase the surface area of the base member;

a positionable axle rotatably coupling a mounting plate with the base member; and the axle positionable to enable one of a plurality of positions including a first position in which the mounting plate pivots above the plane of the base member and a second position in which the mounting plate pivots through the plane of the base member.

13. The device of claim 12, wherein each wing forms an outer edge for carving a turn on snow or ice when the plurality of wings is in the skiing configuration.

14. The device of claim 12, wherein the base member further comprises an opening configured to allow the mounting plate to rotate through the plane of the base member.

15. The device of claim 12, further comprising a removable skiable surface configured to engage the opening of the base member and form a substantially continuous skiing surface.

16. The device of claim 12, further comprising a removable climbing skin having an upper surface configured to engage the base member, and a lower surface configured to engage snow or ice covered terrain.

17. The device of claim 12, further comprising a removable traction device configured to couple to a toe portion of the mounting plate and rotate through the plane of the base member.

18. The device of claim 12, further comprising a removable traction device configured to couple to one of a heel portion of the mounting plate or a bottom surface of the base member.

19. The device of claim 12, further comprising a quick release foot binding configured to releasably couple to the mounting plate.

20. The device of claim 12, wherein the base member is convertible into a device selected from the group consisting of a ski, snowshoe, approach ski, and telemark ski.

21. A device for traversing snow and ice covered terrain, the device comprising:

a base member having a bottom for traversing over snow and ice covered terrain;

an opening in the base member configured to allow a mounting plate to rotate through the plane of the base member;

a removable skiable surface configured to engage the opening of the base member and form a substantially continuous skiing surface;

a positionable axle rotatably coupling a mounting plate with the base member;

the axle positionable to enable one of a plurality of positions including a first position in which the mounting plate pivots above the plane of the base member and a second position in which the mounting plate pivots through the plane of the base member; and a plurality of wings coupled to the base member, the wings convertible between a skiing configuration in which the wings from a surface for gliding over snow and a snowshoe configuration in which the wings extend to increase the surface area of the base member.

22. The device of claim 21, further comprising an outer edge for carving a turn on snow and ice.

23. The device of claim 21, further comprising a removable climbing skin having an upper surface configured to engage the base member, and a lower surface configured to engage snow or ice covered terrain.

* * * * *

UNITED STATES PATENT AND TRADEMARK OFFICE

CERTIFICATE OF CORRECTION

PATENT NO. : 7,681,904 B2
APPLICATION NO. : 11/247893
DATED : March 23, 2010
INVENTOR(S) : Lane Ekberg It is certified that error appears in the above-identified patent and that said Letters Patent is hereby corrected as shown below:

Column 1, Line 26
"for Hi many of"---should read "for many of"

Column 3, Line 51
"illustrating on embodiment"---should read "illustrating one embodiment"

Column 5, Line 26
"member 102*n* accordance"---should read "member 102 in accordance"

Column 6, Line 43
"illustrating on embodiment"---should read "illustrating one embodiment"

Column 7, Line 18
"different sized in order"---should read "different sizes in order"

Column 10, Line 67
"wings from a surface"---should read "wings form a surface"

Column 11, Line 41
"wings from a surface"---should read "wings form a surface"

Column 12, Line 43
"wings from a surface"---should read "wings form a surface"

Signed and Sealed this

Eighth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,681,904 B2
APPLICATION NO. : 11/247893
DATED : March 23, 2010
INVENTOR(S) : Lane Ekberg It is certified that error appears in the above-identified patent and that said Letters Patent is hereby corrected as shown below:

On The Title Page:

"(65) Prior Publication Data
US 2007/0079529 Al Apr. 12, 2007

(51) Int. Cl.
A63C 5/02 (2006.01)"

---should read

Item "(65) Prior Publication Data
US 2007/0079529 A1 Apr. 12, 2007

Related U.S. Application Data

Item (63) Continuation-in-part of application No. 11/044,981, filed on January 27, 2005, and a continuation-in-part of application No. 10/932,777 filed on Sep. 2, 2004, and a continuation-in-part of application No. 10/211,504 filed on Aug. 2, 2002.

Item (51) Int Cl.
A63C 5/02 (2006.01)"

In The Specifications:

<u>Column 1, Line 15</u>

"filed on Jan. 30, 2005 of"---should read "filed on Jan. 27, 2005"

Signed and Sealed this
Sixth Day of March, 2012

David J. Kappos

David J. Kappos
*Director of the United States Patent and Trademark Office*